United States Patent [19]

Stratta et al.

[11] 4,372,006

[45] Feb. 8, 1983

[54] FREIGHT DOOR ROLLER HOUSING

[75] Inventors: Peter J. Stratta, Olympia Fields; John G. Stratta, Orland Park; Douglas M. Camp, Midlothian, all of Ill.

[73] Assignee: Harbor Tool Mfg. Inc., Chicago, Ill.

[21] Appl. No.: 85,609

[22] Filed: Oct. 17, 1979

[51] Int. Cl.[3] ..... E05D 17/00

[52] U.S. Cl. ..... 16/105; 49/220

[58] Field of Search ..... 16/91, 97, 98, 99, 100, 16/102, 103, 104, 105, 106, 107, 48, 32, 19, 43; 49/220, 426; 105/378; 308/158, 156, 151, DIG. 3, 139

[56] References Cited

U.S. PATENT DOCUMENTS

| | | | |
|---|---|---|---|
| 428,557 | 5/1890 | Draper | 308/156 UX |
| 1,585,758 | 5/1926 | Buckwalter | 308/158 X |
| 3,059,289 | 10/1962 | Roland | 16/100 X |
| 3,106,000 | 10/1963 | Beauchamp | 16/98 X |
| 4,109,847 | 8/1978 | Bailey | 49/426 X |

*Primary Examiner*—Andrew V. Kundrat

*Attorney, Agent, or Firm*—Silverman, Cass & Singer, Ltd.

[57] ABSTRACT

A replacement for a freight car roller housing assembly in which there are two hollow wheel wells having rollers journalled therein, the wells being respectively connected by a block extending between them. The block has a vertical cylindrical passageway and one of two different kinds of thimble-shaped bushings engaged therein. One is plain and provides for the bottom end of a plug door pin to be carried therein without provision for vertical adjustment of the pin. The other is threaded and slides vertically in the passageway but can be adjusted by means of an exterior nut threaded at the upper end thereof, the latter bushing adapted to have the bottom end of a plug door pin carried therein and being adjustable vertically by rotating the nut which engages the upper side of the block.

15 Claims, 6 Drawing Figures

FIG. 1
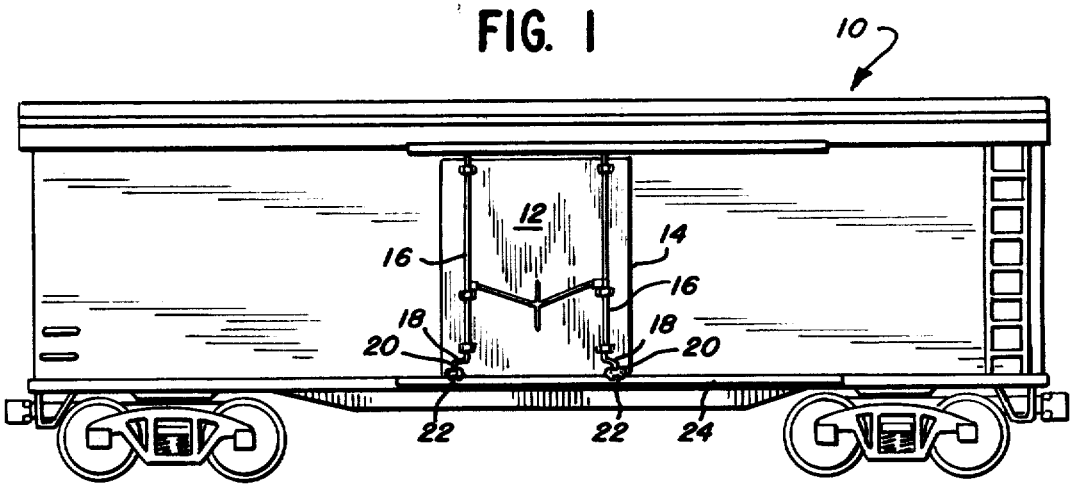
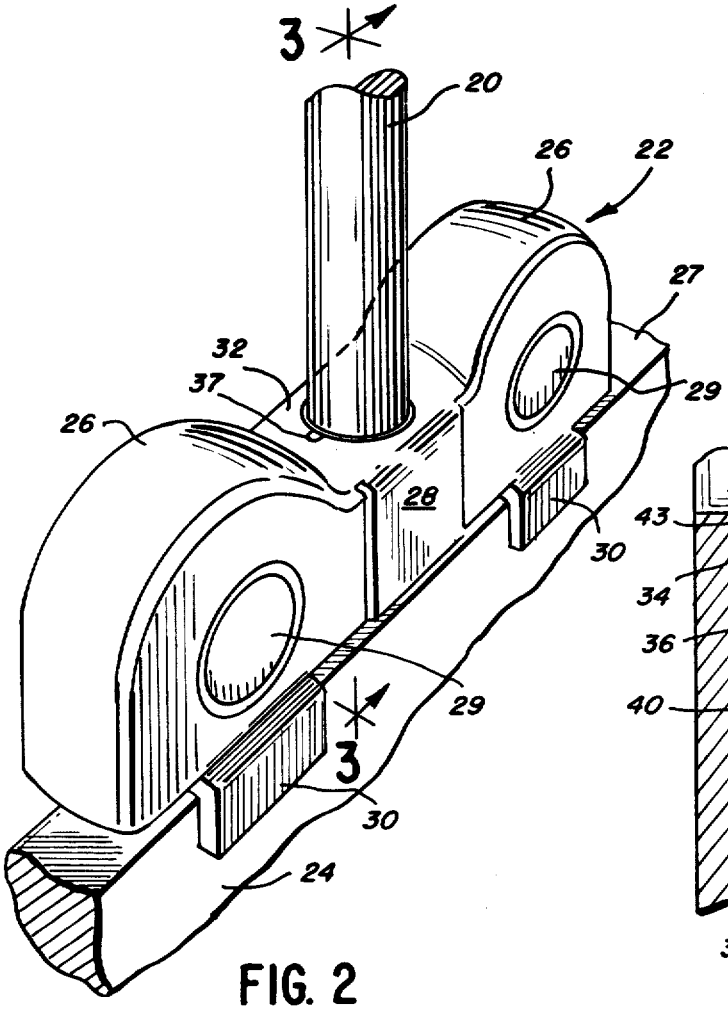
FIG. 2
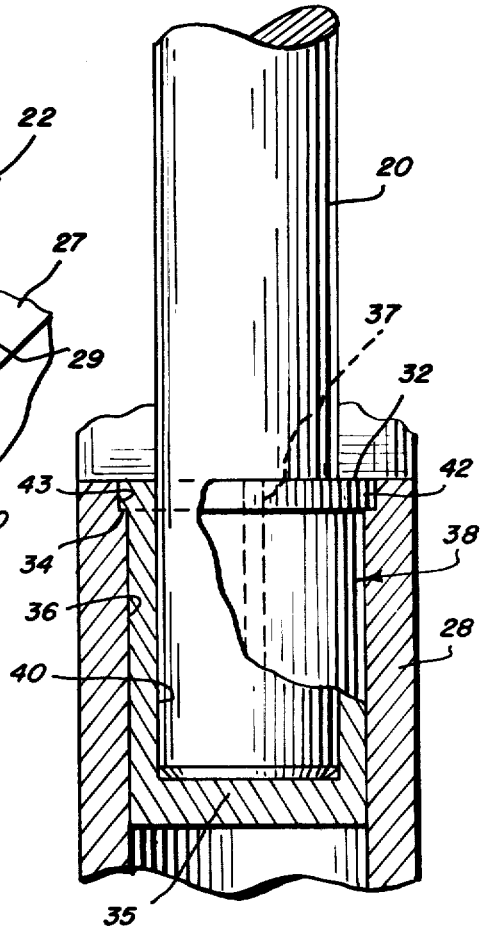
FIG. 3

FREIGHT DOOR ROLLER HOUSING

BACKGROUND OF THE INVENTION

This invention relates to roller housing assemblies for the sliding doors of railroad freight cars and more particularly relates to roller housing assemblies for use with railroad freight cars having so-called plug doors.

The present roller assembly manufactured for use by original equipment manufacturers or produced for replacement of worn or broken roller housing assemblies generally comprises a center block of solid metal connecting two hollow wheel or roller wells. The center block of such a roller assembly has a vertical socket or seat and in many cases such a socket is threaded to receive therein an exteriorly threaded bushing to enable the bushing to be screwed up and down. The bushing has a central socket which is adapted to receive the bottom end of one of the support pins of the plug door. By screwing the bushing up and down, the position of the pin and hence the plug door can be adjusted so that it can be closely aligned with the door opening when ready to be closed.

It should be understood that plug doors are those which slide on rails along the sides of the freight car and, when aligned with the respective door openings, are swung on their supports on the roller housings into the door openings and clamped in place. In other words, for movement, a door slides parallel with the freight car sides and for securement, it is translated laterally into or out of engagement with the door opening. This sort of translative movement means that the doors must be mounted on vertical shafts or rods which have crank formations at their bottom ends, these crank formations terminating in short vertical pins or rods that are mounted in the sockets of the roller housing assemblies. There are normally two such assemblies for each door and these ride upon rails that are secured to the freight car parallel with and about at the same level as the bottom sill of the door openings.

Some door assemblies provide for vertical adjustment of the doors by manipulation of the pin linkages or connections so that the center block of the roller assembly is provided with a plain cylindrical socket that receives the bottom end of the pin. The door may be raised or lowered by adjustments which do not use any change of position of the pins in their sockets.

Railroad freight cars take considerable abuse from freight handlers and the machinery that they use for loading and unloading freight. The sockets of roller housings are distorted and bent; the threads of bushings are stripped and jammed and the bushings themselves are smashed. In such cases the normal procedure has been to replace the entire roller housing assembly because either the socket was cut directly into the housing center block or the block was threaded to receive the threaded bushing.

In recent years, a replacement kit was made available for replacement of several different types of assemblies, but that kit required a threaded socket in the housing for pin reception where the door was vertically adjusted by raising and lowering the pin as opposed to a different type of adjustment not changing the depth of the pin in its socket.

According to the invention, a wide range of different types of roller housing assemblies could be replaced by a single housing structure with one of two different types of bushings assembled therein. A plain one is provided for the replacement of the type of housing wherein the pin is not required to be vertically adjustable within the socket itself, and a theaded one is furnished for the type of housing where the pin is required to be vertically adjustable within the socket. In either case, no work is required to be performed on the housing as furnished to the user and he merely chooses the type of bushing to associate with the housing, drops it in place and he is ready to mount it on its rail and connect to the freight car door mechanism. All he need do is to weld shims, brackets or hooks to feet or tabs depending from the furnished housings and/or trim or eliminate some of these tabs in order to adapt the housing to almost any one of many different kinds of door mechanisms in use today.

The invention need not only be used for replacement, but could be adapted readily by original equipment manufacturers for use with their door mechanisms and equipment as installed when the freight car is newly built.

The invention enables a kit to be furnished to the railroad repair shop with both kinds of bushings, leaving it to the shop personnel to choose the one needed. The modifications of the tabs can be undertaken by cutting, welding, etc., and even the shims, brackets, hooks or other small parts may be furnished with the kit. An advantage of the invention is that once the repair shop has purchased a kit and installed a roller housing assembly, it may not be required to replace the same throughout the normal life of the entire door because, any time the bushing gets damaged, only the small part need be replaced.

Attention is invited to prior art which is known to the applicants and which is presented to show the different forms of freight car door assemblies which use the general type of housing of the invention. Such prior art comprises:

Bailey U.S. Pat. No. 4,109,847

Beauchamp U.S. Pat. No. 3,106,000 and the references cited in each of these patents.

SUMMARY OF THE INVENTION

A roller housing assembly is provided for replacement of the roller assembly of a freight car door mechanism for plug doors.

The roller assembly comprises a pair of hollow wheel wells which have a central block welded between the wells, each of the wells having a roller journalled therein and the rollers adapted to be engaged upon and guided for movement along a rail that is secured to the side of freight cars parallel with and about at the level of the bottom sill of the freight car door. There are normally two such assemblies for each door and the door will have vertically arranged pins on crank arms adapted to be seated in suitable sockets formed in the respective blocks of the roller assemblies.

The invention comprises a structure in which the roller assembly block has a vertical cylindrical passageway extending fully through the same. Either of two different bushings will freely be engageable within the passageway, one comprising a thimble-shaped plain cylindrical bushing having a flanged top that seats in a counterbore formed at the upper end of the passageway; the other comprising an exteriorly threaded bushing freely movable up and down within the passageway and having an adjustable nut that limits the downward movement of the bushing. There is a keyway in the passageway which cooperates with a protruding key fixed to the threaded bushing to prevent the threaded bushing from rotating when the nut is turned.

Each bushing has a central blind bottom end socket to receive therein the bottom end of a freight car door support pin. The plain bushing does not provide for vertical adjustment of the pin in the socket, the vertical adjustment for the door being provided elsewhere; the threaded exterior bushing does provide for vertical adjustment in the socket by rotation of the nut. The exterior diameter of the nut is greater than the diameter of the counterbore so that the nut engages upon the upper surface of the center block of the roller assembly.

If either bushing becomes damaged during use, it can be pushed or knocked out of the passageway in which same is installed from the open bottom of the said passageway by any suitable blunt instrument directed upwardly. This saves replacement of the entire roller housing assembly since the wheel wells, rollers and central block can be used again with a new bushing of one form or the other. This results in great economy and, in the case of the adjustable form of bushing, provides a highly effective yet simple manner of adjusting the door vertically.

BRIEF DESCRIPTION OF THE DRAWINGS

FIG. 1 is a side elevational view of a freight car of the type which uses the roller assembly of the invention;

FIG. 2 is a perspective view of the roller assembly and a door pin showing one of the bushings of the invention;

FIG. 3 is a partial sectional view of the roller assembly and the door pin taken generally along the line 3—3 of FIG. 2 in the direction indicated by the arrows;

DESCRIPTION OF THE PREFERRED EMBODIMENT

Figure 4:
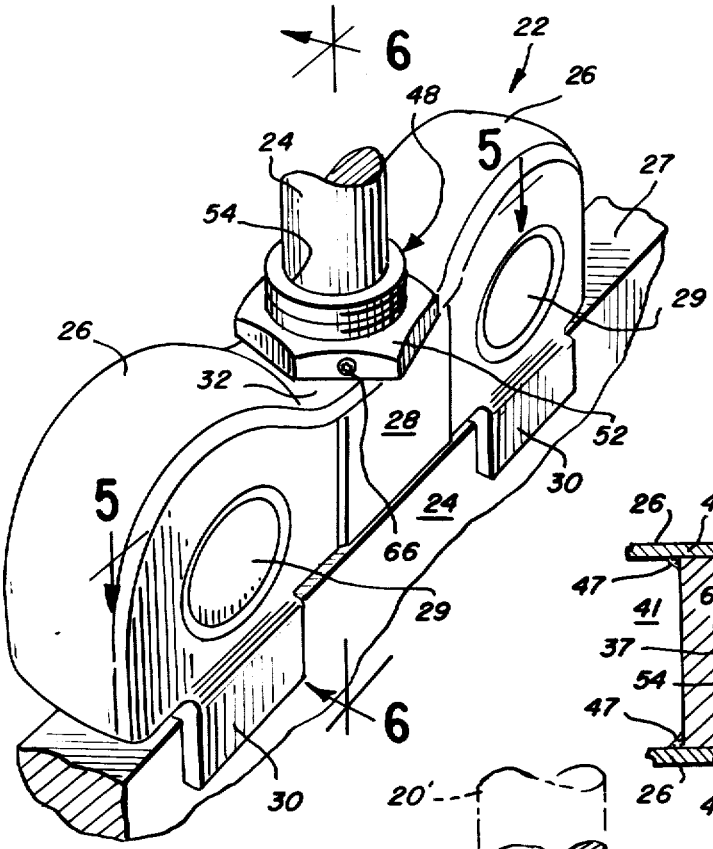
FIG. 4 is a perspective view of the roller assembly showing the alternate bushing of the invention.

As indicated above, the invention herein is concerned with the provision of a railroad freight car door roller housing assembly for plug doors, and while primarily intended for replacement purposes, the roller assembly of the invention is capable of being utilized with original equipment by manufacturers of railroad freight car doors and related equipment.

The description herein is directed to the construction of a freight car door roller housing assembly which is capable of being adapted for use with two different forms of railroad car doors, those which are intended to be vertically adjustable by raising or lowering a pin within a socket carried by the housing and those in which the vertical adjustment of the door is effected by a mechanism in the linkage of the pin above the roller housing so that no adjustment need be provided in the socket of the housing and the vertical position of the pin is fixed. These two forms of door encompass a number of different types of constructions greater than two so that if the railroad freight car door roller housing of the invention is available to a repair shop along with the two different bushings or adapters which are to be described, the housing may serve as a replacement for as many as five or six different door mechanisms.

All of this will become more apparent as the description proceeds, but basically at this point it might be generally indicated that with the same roller housing per se, the user may insert either a plain bushing with a socket or a threaded bushing with a socket, the threaded bushing being adjustable vertically. No modification of the roller housing is required for either type of arrangement.

In FIG. 1 there is illustrated a railroad freight car 10 having a plug door shown at 12 which is adapted to fit into the door opening 14 of the freight car 10 and be tightly and substantially hermetically sealed therein by suitable clamping means, all of which are well-known. A similar arrangement is normally provided on the opposite side of the freight car 10.

The door 12 is arranged to swing into and out of the door opening 14 by pivoting it on vertical shafts or rods 16, crank arms 18 and the pins 20, the bottom ends of the pins being pivotally supported and engaged in suitable sockets carried by roller assemblies 22. The roller assemblies 22 are arranged to be supported by and ride upon a rail 24 which is fixed to the side of the freight car 10 generally located at about the level of or below the bottom sill of the door opening 14.

Figure 5:
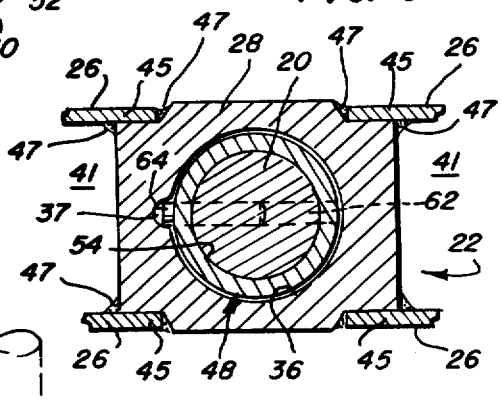
FIG. 5 is a fragmentary sectional view of the roller assembly taken generally along the line 5—5 of FIG. 4 in the direction indicated by the arrows.
Figure 6:
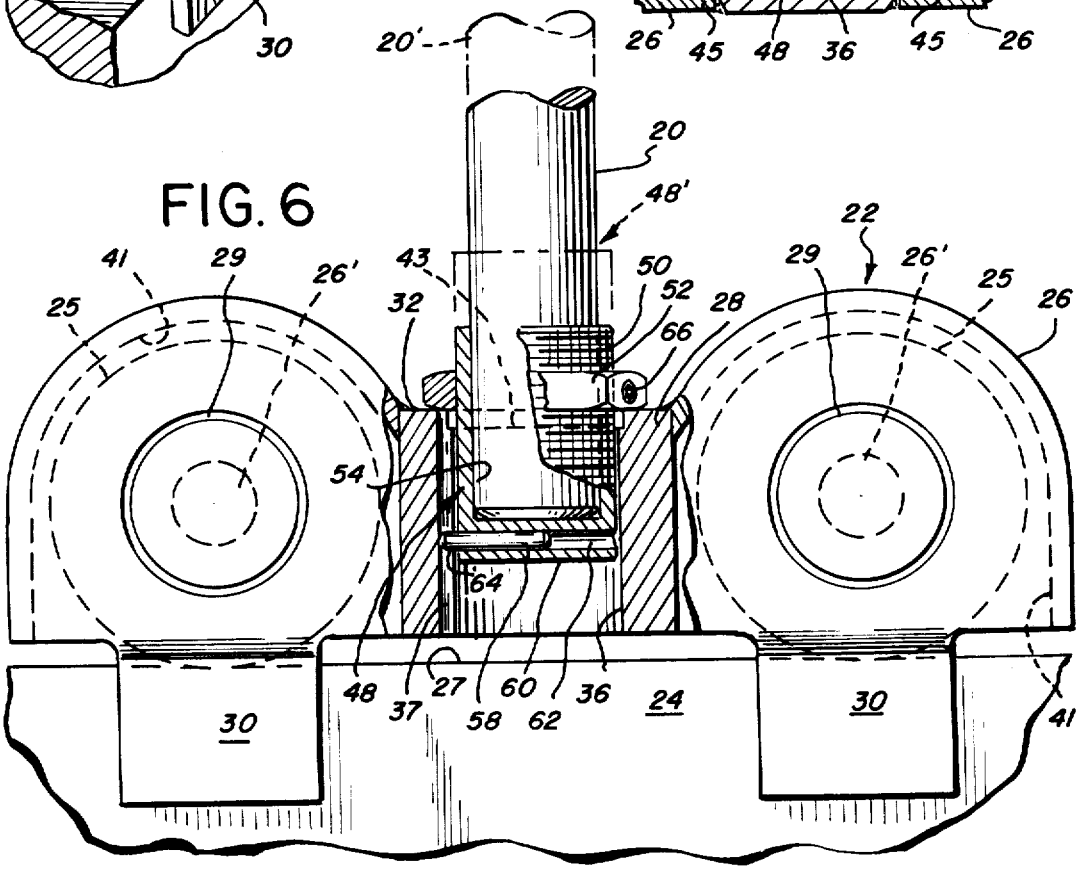
FIG. 6 is a side elevational view of the roller assembly with a portion thereof in section taken generally along the line 6—6 of FIG. 4 in the direction indicated by the arrows.

FIGS. 2 and 3 show the roller housing 22 with a plain bushing or adapter and FIGS. 4, 5 and 6 show the roller housing 22 with a threaded bushing or adapter.

Inviting attention first to FIGS. 2 and 3, the roller assembly 22 includes two hollow wheel wells 26 which enclose the wheels or rollers which are not shown in these views but are illustrated at 25 in FIGS. 4 and 5, the assembly 22 in the latter two views being identical in construction to that of FIGS. 2 and 3. The rollers 25 are mounted on stub axles 26' (see FIG. 6), suitably journalled in the sides of the wheel wells 26, the ends of such journals being sealed as indicated at 29. Each of the wells 26 is fully enclosed except at its bottom end, the rollers 25 being arranged to protrude slightly to enable them to engage and roll upon the upper surface 27 of the rail 24. A center block 28 is provided between the hollow wheel wells 26, being permanently welded in place whereby to form with the wheel wells 26 a rigid integral unit.

Each of the wells 26 has integral depending rectangular guide tabs 30 on both sides thereof, these tabs serving as guides to maintain the roller assembly 22 in place upon the rail 24 during its movement. Various types of arrangements are capable of being made with these tabs and small metal shims or brackets that can be welded to the interior surfaces of the tabs 30 to enable the roller assembly to be accommodated on different rail and door constructions. In some instances, the tabs 30 on one side may be shortened or eliminated altogether. It is well within the capability of those artisans who are skilled in the field of freight car door mechanisms to make such minor modifications as required to accommodate the roller assemblies for practically any type of door construction by cutting, welding shims or brackets or hooks to the tabs 30.

The center block 28 of the roller housing 22 is provided with a center vertical passageway 36 that is a plain cylindrical bore passing fully through the said block 28. The upper end of the passageway 36 opens to the top surface 32 of the center block 28 with a counterbore 43 of somewhat larger diameter than the bore of the passageway 36, the counterbore 43 being cylindrical and coaxial with the passageway 36. This gives rise to a shoulder 34 in the passageway 36. A keyway 37 is cut in the passageway 36 along an edge thereof, said keyway extending parallel to the axis of the passageway along the entire length thereof for a purpose to be explained in connection with FIGS. 4, 5 and 6.

A bushing 38 is provided which is thimble-like in construction, said bushing 38 comprising a tubular cylindrical member having a bottom wall 35 closing the said bottom off and thus giving rise to a blind end socket 40 which opens to the top end of the bushing. At its upper end the bushing 38 has an enlarged exterior substantially rectangular cross-section flange or lip 42 whose axial dimension is substantially the same as that of the counterbore. The thimble-like bushing 38 is dimensioned to fit within the passageway 36 with sufficient clearance so that it can be easily inserted in place without forcing. When so installed, the flange 42 engages within the counterbore and the upper axial end of the bushing is substantially flush with the surface 32. The bushing 38 may be readily removed, if desired, by inserting any blunt tool fitting into the bottom of the passageway 36 and driving the tool upward against the bottom wall 35 which will raise the thimble-like bushing out of the passageway 36.

This form of the invention will accept the bottom end of a pin 20 and provide for pivotal movement of the pin 20 without the need for any other means. The bushing 38 is firmly seated in the block 28 by the weight of the door carried on said pin 20 and, if the bushing should become distorted or worn during use, it is easily replaced without the need for replacing the entire assembly 22. The bushing 38 is extremely simple in form and can readily be machined without complex machine setup. The diameter of the annular flange 42 and its axial thickness must be chosen to withstand the shock of a freight car door bouncing up and down since the flanges of the roller housings for any door carry the weight of the door.

The structure of FIGS. 2 and 3 does not provide for vertical adjustment of the pins 20 within their respective sockets 40, being intended for use with a type of freight car plug door in which vertical door adjustment is effected by providing some form of adjustment elsewhere. Such adjustment means are located, for example, in the connections between crank arms 18 and the pins 20 or between the crank arms 18 and the vertical shafts 16. The structure of FIGS. 4, 5 and 6 is intended for use with a freight car plug door in which vertical door adjustment is effected in the socket itself. This is done in a novel manner by the use of a somewhat different form of bushing illustrated in said FIGS. 4, 5 and 6. In these three figures, the same parts which are shown in FIGS. 2 and 3 have the same reference characters.

In FIGS. 4, 5 and 6, the identical housing 22 with the wheel wells 26, center block 28, rollers 25, axles 26', tabs 30, vertical passageway 36, counterbore 43, etc. is illustrated. Some of the details of the housing 22 are better illustrated, as for example: the hollow chambers 41 which accommodate the rollers 25 are shown together with the side walls 45 of the wells 26 and the manner in which the center block 28 is welded to the wells 26 is shown at 47. Casting as a unit is possible.

The differences between the two forms of the invention lie in the construction of the bushing 48 and its manner of association with the housing 22. The bushing 48 is again somewhat thimble-shaped in that it has a central coaxial blind end socket 54 which is formed by reason of a bottom wall 60 that closes off the bottom end of the socket 54. This socket 54 is of the same size as the socket 40 of FIG. 3 and is designed to receive and accommodate the bottom end of a pin 20. Instead of having a plain cylindrical exterior surface as in the case of the bushing 38, the bushing 48 has its exterior threaded as shown at 50, the outermost or crest diameter of the threads being of such dimension as to enable the bushing 48 to clear the inner surface and move freely in a vertical direction in the passageway 36. There is no upper flange on the bushing 48 similar to the flange 42 of the bushing 38 but there are means to position the bushing 48 axially in the passageway 36, such means comprising the large nut 52 which threadedly engages the upper end of the bushing 48 on the exterior thereof.

The counterbore 43 is not utilized in this form of the invention because the nut 52 cooperates with the upper surface 32 of the block 28 to position the bushing 48 vertically. In the case of the arrangement of FIGS. 2 and 3, the keyway 37 was not utilized, but that element is used in this arrangement. The bottom wall 60 of the bushing 48 is thick enough to accommodate a transverse key-receiving passageway 62 which is drilled normal to the axis of the thimble-shaped bushing 48 across the same. A key 58 which may be in the form of a simple drive-pin is forced into the passageway 62 and dimensioned to be frictionally engaged therein with its tip 64 extending past the crest of the threaded exterior 50. The tip 64 engages in the vertical keyway 37 and prevents rotation of the bushing 48 but without preventing its vertical sliding in the passageway 36. The passageway 62 could be threaded and the key 58 could be a grub screw with an unthreaded tip engaging the keyway 37.

As indicated by the phantom lines of FIG. 6, by rotating the large nut 52 with a suitable tool, the bushing 48 can be moved to any desired position vertically relative to the roller housing 22 in order to adjust the vertical position of the pin 20. This can be done easily, even with the door 12 in place. A low position is shown in solid lines and an upper position is shown by the reference characters 48' and 20' in phantom lines. Once any desired position has been achieved, a suitable set screw 66 which is threaded through the nut to the inner diameter thereof may be screwed home tightly against the threaded surface 50 thereby preventing unwanted rotation of the nut 52 relative to the bushing 48.

The important advantage of the structure of FIGS. 4, 5 and 6 is that, if the bushing 48 should get distorted, damaged or worn during use, as for example, the threads stripped or jammed or the socket worn overly large, the entire bushing 48 with its nut 52 can be driven out of the passageway 36 from the bottom thereof by a blunt instrument after the pin 20 has been withdrawn from the socket 54. The nut 52 can be separated from the bushing 48 and reused if said nut is not damaged. Either of these expedients is considerably more economical than replacing the entire assembly 22, it being unusual that the remainder of the assembly will be damaged during use.

As previously mentioned, many different kinds of door mechanisms which use roller assemblies can be serviced by the roller housing assembly of FIGS. 4, 5 and 6 by means of shims, brackets or hooks welded in place on the tabs 30 and/or by cutting off or trimming certain ones of the tabs.

The invention contemplates that the manufacturer thereof may offer a replacement kit to railroad door repair shops, the kit including the housing 22 with the rollers 25 installed in place and one each of the bushings 38 and 48. The user will install either one of the bushings for his immediate use and either discard or preserve the other. The cost of the bushings is minimal compared to the cost of the housing. If desired, the kit may include shims, brackets, hooks and the like to enable the user to adapt the housing to different kinds of door installations.

Modifications can be made without departing from the spirit or scope of the invention as defined in the appended claims.

What it is desired to claim and secure by Letters Patent of the United States is:

1. A roller assembly for use with the plug door of a railroad freight car in which the door has a vertically arranged support pin adapted to be pivotally connected with said roller assembly and having a cylindrical bottom end, said assembly comprising:

A. a pair of wheel wells each having a roller journalled therein, the wells being hollow and opening to their bottoms and the rollers having their bottom segments protruding from the said bottom openings and adapted to ride upon a rail of the said freight car and the wheel wells having means for guiding the assembly as it rides said rail;

B. a center block connecting the wells and forming therewith an integral structure, the block having an upper side, C. a central vertical cylindrical passageway through the block; and D. a bushing of generally thimble-shaped construction, having a central socket with a blind bottom end, the socket adapted to receive the bottom end of of a support pin therein in pivotal engagement, said bushing having a slide fit engagement with said passageway and being inserted therein from the top end thereof, said bushing having means adjacent the upper end thereof cooperating with said upper side for retaining the bushing in position within said passageway against movement through the passageway downward but being free to be pushed upward and out of the passageway from the bottom end of the passageway, the bushing being plain on its exterior and being retained in a single vertical location within said passageway, and an annular counterbore in the upper end of the passageway larger in diameter than the passageway and forming an annular shoulder adjacent said upper end and said bushing including a flange seated on said shoulder in said counterbore, said counterbore, shoulder and flange comprising said retaining means.

2. The assembly as claimed in claim 1 in which the flange mates substantially with said counterbore whereby the upper end of said bushing is substantially flush with the upper side of said block.

3. A roller assembly for use with the plug door of a railroad freight car in which the door has a vertically arranged support pin adapted to be pivotally connected with said roller assembly and having a cylindrical bottom end, said assembly comprising:

A. a pair of wheel wells each having a roller journalled therein, the wells being hollow and opening to their bottoms and the rollers having their bottom segments protruding from the said bottom openings and adapted to ride upon a rail of the said freight car and the wheel wells having means for guiding the assembly as it rides said rail;

B. a center block connecting the wells and forming therewith an integral structure, the block having an upper side, C. a central vertical cylindrical passageway through the block;

D. a bushing of generally thimble-shaped construction, having a central socket with a blind bottom end, the socket adapted to receive the bottom end of a support pin therein in pivotal engagement, said bushing having a slide fit engagement with said passageway and being inserted therein from the top end thereof, said bushing having means adjacent the upper end thereof cooperating with said upper side for retaining the bushing in position within said passageway against movement through the passageway downward but being free to be pushed upward and out of the passageway from the bottom end of the passageway, the bushing having an exterior thread whose crest diameter is less than the interior diameter of said passageway, there being a nut engaged on said thread bearing against said upper side of the block and rotatable to adjust the vertical disposition of said bushing in said passageway, said nut and thread comprising said retaining means; and E. means for preventing rotation of the bushing in the passageway while permitting axial sliding thereof.

4. The assembly as claimed in claim 3 in which said last-mentioned means comprise a key and keyway connection between said bushing and the interior of said passageway.

5. The assembly as claimed in claim 4 in which said key is a projection from one of said passageway and said bushing, and said keyway is a slot in the other of said passageway and said bushing parallel to the axis of and extending the length of said other, said key extending into said keyway.

6. The assembly as claimed in claim 5 in which there is a transverse passageway in the bottom wall of said bushing and there is a pin in said transverse passageway extending beyond the circumference of said bushing and forming said projection.

7. The assembly as claimed in claim 3 in which there is a set screw threaded in an opening through said nut to the inner diameter thereof, said set screw engaging said bushing thread when screwed into said nut.

8. A bushing for use with a roller housing assembly of a plug door of a railroad freight car in which the door has a support pin that is vertically arranged and pivotally connected to the assembly to enable the door to be slid while the assembly rolls along a track and to enable the door to be translated laterally on the pin, the housing assembly including at least rollers mounted at opposite ends, wheel wells covering the rollers, a center block connecting the wells together in a unitary assembly, the center block having a through vertical cylindrical passageway and an upper side, an annular counterbore in the upper end of the passageway and forming a shoulder thereat, the bushing comprising a cylindrical cup having a central blind bottom end socket adapted to receive a support pin pivotally therein, the cup having a slide fit engagement with the passageway and being adapted for insertion in the passageway from the top end thereof, the cup having means adjacent the upper end thereof adapted to cooperate with the upper side for retaining the vertical disposition of the cup in the passageway if fitted therein, the cup being plain on its exterior and being retained in a single vertical location within the passageway, and the cup including an annular flange adapted to be seated on said shoulder in said counterbore, said flange comprising said retaining means.

9. The bushing as claimed in claim 8 in which the flange is adapted to mate substantially with said counterbore whereby the upper end of said cup is substantially flush with the upper side of said block if the cup is fitted in the passageway.

10. A bushing for use with a roller housing assembly of a plug door of a railroad freight car in which the door has a support pin that is vertically arranged and pivotally connected to the assembly to enable the door to be slid while the assembly rolls along a track and to enable the door to be translated laterally on the pin, the housing assembly including at least rollers mounted at opposite ends, wheel wells covering the rollers, a center block connecting the wells together in a unitary assembly, the center block having a through vertical cylindrical passageway and an upper side, an annular counterbore in the upper end of the passageway and forming a shoulder thereat, the bushing comprising:

a cylindrical cup having a central blind bottom end socket adapted to receive a support pin pivotally therein, the cup having a slide fit engagement with the passageway and being adapted for insertion in the passageway from the top end thereof, the cup having means adjacent the upper end thereof adapted to cooperate with the upper side for retaining the vertical disposition of the cup in the passageway if fitted therein, the cup having an exterior thread whose crest diameter is less than the interior diameter of said passageway, there being a nut rotatably engaged on said thread adapted for bearing against said upper side to adjust the vertical disposition of the cup in the passageway if fitted therein, said nut and thread comprising said retaining means, and means being provided to prevent rotation of the cup in the passageway while permitting axial sliding thereof.

11. The bushing as claimed in claim 10 in which said last-mentioned means comprise one of a key and keyway of a key and keyway connection between said cup and the interior of said passageway.

12. The bushing as claimed in claim 11 in which said key is a projection from said cup adapted to engage in said keyway cut in said passageway.

13. The bushing as claimed in claim 12 in which there is a transverse passageway in the bottom wall of said cup and there is a pin in said transverse passageway extending beyond the circumference of said cup and forming said projection.

14. The bushing as claimed in claim 10 in which there is a set screw threaded through said nut to the inner diameter thereof, said set screw engaging said cup thread when screwed into said nut to prevent turning of said nut relative to said cup.

15. A kit for replacing the roller housing assembly of a railroad freight car door of the plug type which has a support pin that is vertically arranged and pivotally connected to said housing assembly to enable the door to be slid while the housing rolls along a track and to enable the door to be translated laterally on said pin, said kit adapted to serve as replacement for either one of two types of door structures, one of which is vertically adjustable by vertical movement of said pin relative to the housing and the other of which does not require vertical adjustment of the said pin relative to the housing, said kit including at least the following parts:

A. a roller housing with rollers mounted at opposite ends, wheel wells covering said rollers and having a center block connecting the wells together in a unitary assembly,
   1. the center block having a through vertical cylindrical passageway,
   2. an annular counterbore in the upper end of the passageway and forming a shoulder thereat, B. a first bushing comprising a cylindrical cup having a central blind bottom end socket adapted to receive a support pin pivotally therein, said bushing having a plain outer surface adapted to slidably fit in said passageway and an upper annular exterior flange adapted to engage said counterbore so that, if fitted into said passageway, said first bushing will be retained in fixed vertical disposition, C. a second bushing comprising a cylindrical cup having a central blind bottom end socket adapted to receive a support pin pivotally therein, said bushing having an exterior thread whose crest diameter is less than the interior diameter of said passageway, there being a nut rotatably engaged on said thread adapted to bear against the upper side of said center block so that if fitted into said passageway said second bushing will be retained in adjustable vertical disposition D. the second bushing and vertical cylindrical passageway having means cooperating when the second bushing is inserted into the passageway to prevent rotation of the second bushing.

* * * * *